US005777435A

United States Patent [19]

Claassen et al.

[11] Patent Number: 5,777,435

[45] Date of Patent: Jul. 7, 1998

[54] ELECTRIC LAMP HAVING A CURRENT CONDUCTOR WITH A KINKED LONGITUDINAL PORTION

[75] Inventors: Wilhelmus C. M. Claassen; Wilhelmus A. A. A. Martens; Jacobus J. Boonekamp, all of Eindhoven, Netherlands

[73] Assignee: U.S. Philips Corporation, New York, N.Y.

[21] Appl. No.: 734,007

[22] Filed: Oct. 18, 1996

[30] Foreign Application Priority Data

Oct. 20, 1995 [EP] European Pat. Off. ..... 95202850

[51] Int. Cl.[6] ..... H01K 1/50

[52] U.S. Cl. ..... 313/578; 313/313; 313/583

[58] Field of Search ..... 313/331, 333, 313/335, 580, 113, 578, 583, 584, 587

[56] References Cited

U.S. PATENT DOCUMENTS

| | | | |
|---|---|---|---|
| 3,287,591 | 11/1966 | Sloan | 313/333 |
| 4,734,614 | 3/1988 | Kuus | 313/112 |
| 4,918,353 | 4/1990 | Nelson et al. | 313/331 |
| 5,115,381 | 5/1992 | Van Heeswijk | 362/61 |
| 5,130,604 | 7/1992 | Franks, Jr. et al. | 313/331 |
| 5,216,318 | 6/1993 | Van Dulmen et al. | 313/318.03 |
| 5,216,319 | 6/1993 | Van Heeswijk | 313/318 |
| 5,378,958 | 1/1995 | Van Heeswijk | 313/318 |
| 5,646,471 | 7/1997 | Scholler et al. | 313/112 |

FOREIGN PATENT DOCUMENTS

| | | | |
|---|---|---|---|
| 0595412A1 | 10/1993 | European Pat. Off. | H01J 61/34 |
| 0618609A1 | 3/1994 | European Pat. Off. | H01K 1/46 |

*Primary Examiner*—George M. Dombroske
*Assistant Examiner*—Max H. Noori
*Attorney, Agent, or Firm*—Walter M. Egbert

[57] ABSTRACT

The Electric lamp has a lamp vessel in which an electric element is accommodated, connected to current conductors which emanate from the lamp vessel. At least one of the current conductors has a length portion which is a solidified melt and in the area of which portion the current conductor has a kink. As a result of the conductor having a kink the electric element is aligned in the lamp vessel. The lamp can be obtained by melting the current conductor, e.g. by means of a laser, in the finished lamp.

7 Claims, 1 Drawing Sheet

ELECTRIC LAMP HAVING A CURRENT CONDUCTOR WITH A KINKED LONGITUDINAL PORTION

BACKGROUND OF THE INVENTION

The invention relates to an electric lamp provided with:

a light-transmitting lamp vessel which is closed in a vacuumtight manner and which has an axis;

an electric element arranged in the lamp vessel;

current conductors connected to the electric element and issuing from the lamp vessel to the exterior.

Such an electric lamp is known from EP-A 0 618 609 (PHN 14.426).

The known lamp has a lamp cap which is securely connected to the lamp vessel and has an incandescent body as the electric element which is axially positioned in the lamp vessel and which has a predetermined position relative to reference points at the lamp cap. This position is achieved in that the lamp cap is composed of more than one part, a first part comprising the reference points and a second part being fastened to the lamp vessel. The first part is connected to the second part via an initially movable, then fixed joint after the incandescent body has been placed in the desired position through a displacement of the lamp vessel. The lamp may be used in an optical system, for example in a vehicle headlight.

A capped electric lamp is known from U.S. Pat. No. 5,115,381 whose divided lamp cap has two fixed joints which keep the electric element in position relative to reference points of the lamp cap.

An electric lamp is known from EP-A-0 595 412 whose electric element is a pair of electrodes in an ionizable medium and whose lamp vessel is fixed in a reflector, for example with cement, after the pair of electrodes has been aligned relative to a reference of the reflector through a displacement of the lamp vessel.

An electric lamp is known from U.S. Pat. No. 5,216,319 whose electric element is a pair of electrodes in an ionizable medium and whose lamp vessel is securely fastened to a lamp cap. The pair of electrodes together with the lamp vessel was previously displaced so as to bring the pair of electrodes into a predetermined position relative to references at the lamp cap. This lamp is suitable for use in a vehicle headlight. Such lamps are also known from U.S. Pat. No. 5,378,958, U.S. Pat. No. 5,412,275, EP-A-0 570 068 (PHN 14.063), EP-A-0 576 071 (PHN 14.090), EP-A-0 581 354 (PHN 14.128), EP-A-0 579 313 (PHN 14.133) and EP-A-0 658 920 (PHN 14.693) and described in Applications of earlier date EP 94 20 13 18.6 (PHN 14.852), EP 94 20 14 16.8 (PHN 14.863), EP 94 20 32 76.4 (PHN 15.094), EP 94 20 37 50.8 (PHN 15.148), EP 95 20 11 07.0 (PHN 15.305) and EP 95 20 11 50.0 (PHN 15.311).

An accurate position of the electric element is desired inter alia when an electric lamp is destined for use in an optical system. The degree of accuracy depends on the requirements imposed on the system. The degree to which an electric element must be capable of alignment during lamp manufacture depends partly on the requirements of the system, partly on the accuracy with which the electric element is positioned relative to the lamp vessel. The electric element may be transverse to the lamp vessel axis or parallel thereto, or may be coaxial.

In spite of a high degree of accuracy with which the electric element can be positioned in the lamp vessel, a fine adjustment is still necessary for many lamp types during mounting, for example during mounting in a lamp cap. This fine adjustment not only relates to an adjustment in axial direction of the lamp vessel, which adjustment concerns the distance to a lamp cap, i.e. the depth to which the lamp vessel projects into the lamp cap, but also an adjustment in directions transverse to the axis of the lamp vessel.

It is a disadvantage of the known lamp that the electric element does not occupy a predetermined position in the lamp vessel in directions transverse to the axis.

SUMMARY OF THE INVENTION

It is an object of the invention to provide an electric lamp of the kind described in the opening paragraph in which the electric element occupies a predetermined position in the lamp vessel in directions transverse to the axis.

According to the invention, this object is achieved in that at least one of the current conductors has a longitudinal portion inside the lamp vessel which is a solidified melt, at the area of which longitudinal portion the current conductor is kinked.

The lamp according to the invention may be obtained through the use of a laser, for example a Nd-YAG laser. The lamp vessel may be closed already and provided with its filling, if any, during this. The current conductor which is so directed that it positions the electric element in an incorrect location in the lamp vessel is irradiated with a laser through the lamp vessel wall for a short period, so that a longitudinal portion melts resulting in bending and kinking in the current conductor, which brings the electric element into position in the lamp vessel. The solidified melt is recognizable from its smooth surface which lacks drawing lines created during making of the wire from which the conductor was formed. Usually, the surface of the conductor is also somewhat convex in this spot.

The bending force may be the force of gravity. Before the melt is made, the lamp vessel is so rotated in that case that the relevant current conductor is initially above the final position with its portion connected to the electric element. Alternatively, a current may be passed through the lamp vessel and a magnetic field may be applied around the lamp vessel, for example by means of a coil. When the melt has been made, Lorentz forces will drive the electric element with the adjoining portion of the associated current conductor into its new, aligned position.

Energy and duration of the laser pulse are set in dependence on the dimensions of the current conductor, the mass of the electric element, and the degree of misalignment. Those skilled in the art are capable of determining the conditions for positioning the electric element for a certain type of electric lamp in a small test series.

If so required for an individual lamp from a series in order to achieve a predetermined aligned position of the electric element, both current conductors have a longitudinal portion which is a solidified melt, at the area of which longitudinal portions the current conductors are kinked.

The electric element may be positioned transversely to the lamp vessel axis, but in many lamp types the electric element is preferably arranged axially in the lamp vessel. The electric element may be a pair of electrodes in an ionizable medium or an incandescent body, for example in an inert gas comprising a halogen or halogen compound, such as hydrogen halides.

The position of the electric element, aligned relative to the lamp vessel, renders it easy to position the electric element accurately by simple means relative to references of a lamp cap while the lamp vessel is being fixed therein. Without said accurate position, however, two joints between the electric element and the references would also provide a solution for a high accuracy.

The invention is of particular importance, however, where the electric element must be aligned not or not only relative to a lamp cap, but relative to the lamp vessel itself, such as is the case when the lamp vessel is or is to be coated at an outer surface thereof with an IR-reflecting filter, and the electric element is an incandescent body. Such a light-transmitting, IR-reflecting filter has the object of throwing back IR radiation onto the incandescent body and thus reducing the energy consumption of the lamp, because less energy need be supplied for keeping the incandescent body at the desired temperature. Reflections, however, are always imperfect. No material reflects radiation for 100%. It is accordingly important for reflected IR radiation actually to hit the incandescent body directly, and not after additional, imperfect reflections. It is necessary for this purpose that the incandescent body should be accurately positioned inside the lamp vessel itself, inside the filter.

The lamp vessel may be made of glass, for example of hard glass or glass with an $SiO_2$ content of, for example, at least 96% by weight, or alternatively of ceramic material such as, for example, sintered alumina.

The lamp vessel may be enclosed in an outer envelope which may or may not be vacuumtight. The outer envelope may be a reflector body with a concave reflecting, for example mirrorized surface. The reflector body may be closed with a glass plate or lens and may support a lamp cap.

The current conductors may each be one body, for example a wire, which extends from outside the lamp vessel through the wall thereof into the lamp vessel up to the electric element. An end portion of the current conductor inside the lamp vessel may be the point of application of a discharge arc and may form one of the electrodes. The current conductor may have a coiling of wire around it, for example tungsten wire, for example at or adjacent said end portion.

The current conductors may alternatively be composite bodies. In many lamp types, for example lamps having quartz glass lamp vessels, the current conductors comprise a molybdenum wire outside the lamp vessel, a metal foil in the lamp vessel wall, and an internal wire, for example of tungsten, which extends from said foil into the lamp vessel. The internal wire may be directly connected to the electric element, or an end portion of this wire may form an electrode of the electric element.

The internal wire, or the wire extending from the outside to the inside of the lamp vessel, may alternatively be connected to a wire which is integral with an incandescent body and which may be coiled, for example helically, and which may be short-circuited by a wire accommodated therein, for example made of tungsten or molybdenum. The longitudinal portion of the internal current conductor formed by a solidified melt may be any portion of the current conductor inside the lamp vessel.

A lamp vessel coated with an IR filter, for example an interference filter, may have, for example, a cylindrical or ellipsoidal surface and a cylindrical incandescent body concentric therewith. The filter is preferably provided after the incandescent body was aligned and positioned.

BRIEF DESCRIPTION OF THE DRAWING

Embodiments of the electric lamp according to the invention are shown in the drawing, in which.

DESCRIPTION OF THE PREFERRED EMBODIMENTS

Figure 1:
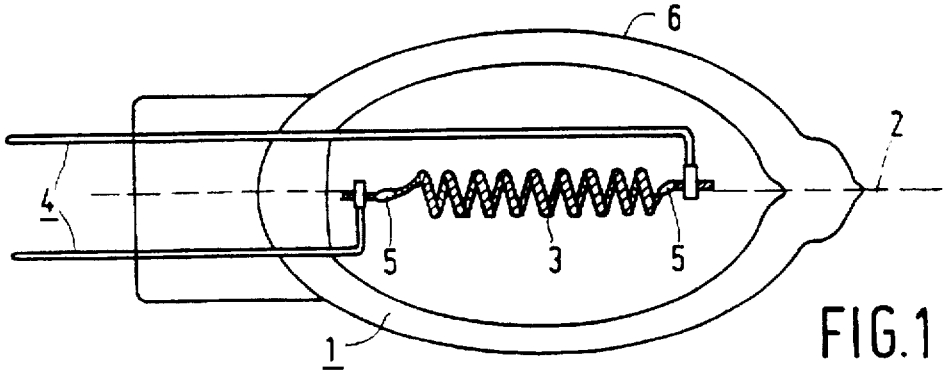
FIG. 1 shows an incandescent lamp in side elevation.

The electric lamp in FIG. 1 is provided with a light-transmitting lamp vessel 1, made of hard glass in the Figure, which is closed in a vacuumtight manner and has an axis 2. An electric element 3, a coiled-coil (cc) incandescent body in the Figure, is arranged in the lamp vessel. Current conductors 4 connected to the electric element 3 issue from the lamp vessel 1 to the exterior. The lamp vessel is filled with an inert gas, for example $Xe/N_2$, which comprises hydrogen bromide.

At least one of the current conductors 4 has a longitudinal portion 5 which is a solidified melt inside the lamp vessel 1. The current conductor is kinked at the area of said longitudinal portion 5.

In the Figure, both current conductors 4 have such a longitudinal portion 5 which is a solidified melt and where the current conductor is kinked.

The incandescent body is positioned axially in the lamp vessel. The lamp vessel 1 has an ellipsoidal outer surface which is coated with an IR-reflecting filter 6. The incandescent body surrounds the major axis of the ellipsoid, which axis coincides substantially with the axis 2 of the lamp vessel. The filter 6 in the Figure is built up from alternating layers of $SiO_2$ and $Nb_2O_5$. Alternatively, however, the filter may be realized from a material of comparatively high reflective index such as $Si_3N_4$ or $Ta_2O_5$. It is also possible for layers of intermediate refractive index to be included in the filter, such as layers of $SiO_xN_y$.

Figure 2:
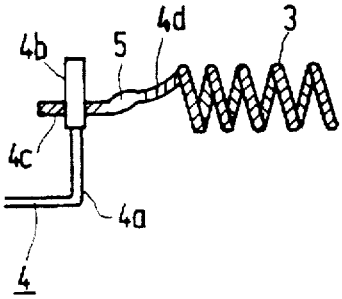
FIG. 2 is a detail from FIG. 1.

In FIGS. 1 and 2, the current conductors 4 each comprise a wire 4*a* of Mo which is folded back inside the lamp vessel 1. The fold 4*b* is pinched around a portion 4*c* of the current conductor which as a result is held securely clamped in. The portion 4*c* is a single-coil (sc) tungsten wire in which a coiling mandrel of Mo is still present. An end portion of 4*c*, the longitudinal portion 5 of the current conductor 4, was melted by means of a laser pulse so as to center the incandescent body relative to the filter 6. The current conductor 4 is substantially composed of an sc tungsten wire without an Mo coiling mandrel between the longitudinal portion 5 and the incandescent body. In the embodiment shown, the portions 4*c* and 4*d* are integral with the incandescent body. In the lamp shown, however, the longitudinal portion 5 could alternatively have been chosen to lie on the Mo wire 4*a*, for example on the portion thereof parallel to the axis 2.

After the lamp vessel had been provided with its gas filling and had been closed so as to be vacuumtight, the incandescent body was aligned relative to the outer surface of the lamp vessel 1 of the lamp shown, i.e. relative to the filter 6 to be provided later.

The incandescent body is coiled from W-wire of 60 μm. The primary windings are made on an Mo coiling mandrel of 150 μm. The incandescent body was one millimeter from its desired position at both ends, in opposite directions. The lamp was ignited and consumed a power of 60 W at 110 V. A magnetic field was applied around the incandescent body. A pulse with an energy content of 2 J was aimed at the longitudinal portion 5 by means of a Nd-YAG laser for 10 ms. The incandescent body was brought into its aligned position thereby.

Figure 3:
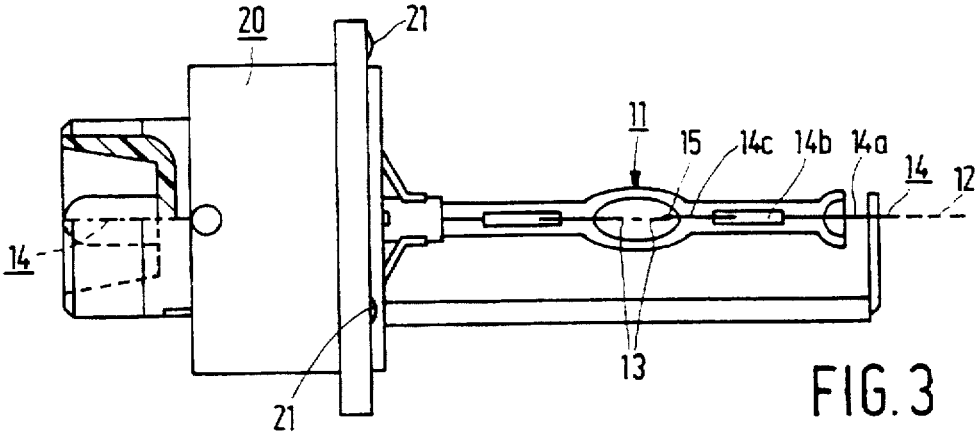
FIG. 3 shows a discharge lamp in side elevation.

The lamp shown in FIG. 3 has a quartz glass lamp vessel 11 with an axis 12 in which a pair of electrodes is axially arranged so as to form the electric element 13. The current conductors 14 each comprise an outer conductor 14*a* of Mo to which a foil 14b is welded. An internal conductor 14c of W is welded thereto, forming an electrode of the electrode pair 13 at its free end. The lamp has a lamp cap 20 with reference locations 21. One of the current conductors has a longitudinal portion 15 which is a solidified melt and where the current IYC conductor is kinked. The electrode was brought onto the axis 12 with its end face in that way, the end face being a point of application of a discharge arc during operation. The other electrode had already been positioned on said axis during lamp manufacture. The distance from the pair of electrodes 13 to the reference locations is all that remains to be adjusted during mounting of the lamp cap 20, since the pair of electrodes is already axially positioned in the lamp vessel.

Figure 4:
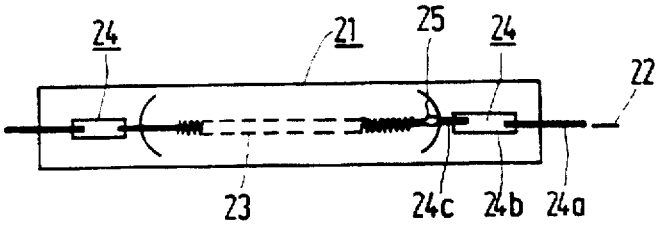
FIG. 4 shows an alternative incandescent lamp in side elevation.

In FIG. 4, the current conductors 24 each comprise a Mo wire 24a issuing from the quartz glass lamp vessel 21 to the exterior, a Mo foil 24b embedded in the glass, and a W-wire 24c entering the lamp vessel and welded to the incandescent body 23. The wire 24c, 250 μm thick in the Figure, comprises a longitudinal portion 25 which is a solidified melt of the material of this portion. The current conductor 24 is kinked in situ such that the incandescent body 23 is centered in the tubular lamp vessel on the axis 22 thereof.

We claim:

1. An electric lamp comprising:

a light transmitting lamp vessel which is closed in a vacuumtight manner and which has an axis;

an electric element arranged in the lamp vessel;

current conductors connected to the electric element and issuing from the lamp vessel to the exterior, wherein at least one of the current conductors has a kinked longitudinal portion inside the lamp vessel which is a solidified melt of said current conductor.

2. An electric lamp as claimed in claim 1, wherein both current conductors each have a kinked longitudinal portion which is a solidified melt of said current conductor.

3. An electric lamp as claimed in claim 1, wherein the electric element is axially positioned in the lamp vessel.

4. An electric lamp as claimed in claim 3, wherein the lamp vessel is coated with an IR-reflecting filter at an outer surface and in that the electric element is an incandescent body.

5. An electric lamp as claimed in claim 2, wherein the electric element is axially positioned in the lamp vessel.

6. An electric lamp as recited in claim 1, wherein the solidified melt is the same material as the adjoining portions of the current conductor.

7. A method for manufacturing an electric lamp, comprising:

providing a light transmitting lamp vessel which is closed in a vacuumtight manner and which has an axis, an electric element, and current conductors connected to the electric element;

positioning the electric element in the lamp vessel such that the current conductors issue from the lamp vessel to the exterior thereof;

melting a longitudinal portion of at least one of the current conductors within the lamp vessel by applying a predetermined amount of energy to the longitudinal portion; and displacing the electric element and an adjoining portion of the current conductor connected thereto, thereby forming a kink in said longitudinal portion of said current conductor.

* * * * *